US008915831B2

(12) United States Patent
Walker et al.

(10) Patent No.: US 8,915,831 B2
(45) Date of Patent: Dec. 23, 2014

(54) SYSTEM AND METHOD FOR AUTOMATING PACKAGE ASSEMBLY

(75) Inventors: John Oliver Walker, Rochester, NY (US); Robert Roy Buckley, Rochester, NY (US); Barry Glynn Gombert, Rochester, NY (US); Philip Crane Rose, Sodus, NY (US); Jennifer Colleen Perotti, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 1474 days.

(21) Appl. No.: 12/121,465

(22) Filed: May 15, 2008

(65) Prior Publication Data

US 2009/0282782 A1 Nov. 19, 2009

(51) Int. Cl.
*B31B 1/00* (2006.01)

(52) U.S. Cl.
USPC ..... 493/1; 493/23; 493/439

(58) Field of Classification Search
CPC ..... B31B 2201/252; B31B 2221/10; B31B 21/00; B31B 1/06; B31B 1/20; B31B 19/36
USPC ..... 493/1, 2, 23, 248, 439, 479, 476
See application file for complete search history.

(56) References Cited

U.S. PATENT DOCUMENTS

| | | | | |
|---|---|---|---|---|
| 3,902,655 | A | 9/1975 | Huffman | |
| 4,167,265 | A * | 9/1979 | Whittenberger | 493/421 |
| 4,834,695 | A * | 5/1989 | Boblit et al. | 493/1 |
| 5,078,666 | A * | 1/1992 | Porret et al. | 493/1 |
| 5,104,365 | A * | 4/1992 | Sone et al. | 493/1 |
| 5,235,519 | A | 8/1993 | Miura | |
| 5,291,583 | A | 3/1994 | Bapat | |
| 5,353,390 | A | 10/1994 | Harrington | |
| 5,364,017 | A | 11/1994 | Bennett | |
| 5,454,644 | A | 10/1995 | Augustin | |
| 5,457,904 | A | 10/1995 | Colvin | |
| 5,513,117 | A | 4/1996 | Small | |
| 5,518,574 | A | 5/1996 | Yates et al. | |
| 5,528,517 | A | 6/1996 | Loken | |
| 5,687,087 | A | 11/1997 | Taggart | |
| 5,768,142 | A | 6/1998 | Jacobs | |
| 5,805,784 | A | 9/1998 | Crawford | |
| 5,838,574 | A | 11/1998 | Olson et al. | |

(Continued)

FOREIGN PATENT DOCUMENTS

| | | | |
|---|---|---|---|
| WO | 2005000681 | A2 | 1/2005 |
| WO | 2005054983 | A2 | 6/2005 |
| WO | 2005122079 | A2 | 12/2005 |
| WO | WO 2007021920 | | 2/2007 |

OTHER PUBLICATIONS

Liang Lu et al, "Folding Cartons with Fixtures: A Motion Planning Approach", IEEE Transactions on Robotics and Automation, vol. 16, No. 4, Aug. 2000.

(Continued)

*Primary Examiner* — Sameh H. Tawfik
(74) *Attorney, Agent, or Firm* — Fox Rothschild LLP

(57) ABSTRACT

A system and method of automatically assembling a package may include maintaining a data structure comprising a dynamic rule set for package production. A desired package may be selected for assembly. An assembly sequence may automatically be developed to create a three dimensional package from the dynamic rule set based on the desired package. The desired package may be assembled using the assembly sequence.

19 Claims, 7 Drawing Sheets

(56) References Cited

U.S. PATENT DOCUMENTS

| | | | |
|---|---|---|---|
| 5,881,538 | A | 3/1999 | Blohm |
| 5,923,556 | A | 7/1999 | Harris |
| 6,005,959 | A | 12/1999 | Mohan et al. |
| 6,090,027 | A | 7/2000 | Brinkman |
| 6,092,054 | A | 7/2000 | Tackbary et al. |
| 6,117,061 | A | 9/2000 | Popat et al. |
| 6,134,018 | A | 10/2000 | Dziesietnik et al. |
| 6,153,039 | A | 11/2000 | Jacobsen |
| 6,237,787 | B1 | 5/2001 | Gallo et al. |
| 6,243,172 | B1 | 6/2001 | Gauthier et al. |
| 6,246,468 | B1 | 6/2001 | Dimsdale |
| 6,310,964 | B1 | 10/2001 | Mohan et al. |
| 6,332,149 | B1 | 12/2001 | Warmus et al. |
| 6,409,019 | B1 | 6/2002 | Hornsby et al. |
| 6,687,016 | B2 | 2/2004 | Gauthier |
| 6,689,035 | B1 | 2/2004 | Gerber |
| 6,771,387 | B2 | 8/2004 | Gauthier |
| 6,895,549 | B1 | 5/2005 | Albright et al. |
| 6,896,250 | B2 | 5/2005 | Hillebrand |
| 6,939,063 | B2 | 9/2005 | Bussell |
| 6,948,115 | B2 | 9/2005 | Aizikowitz et al. |
| 6,953,513 | B1 | 10/2005 | Volkert |
| 7,013,616 | B1 | 3/2006 | Powers et al. |
| 7,197,465 | B1 | 3/2007 | Hu et al. |
| 7,243,303 | B2 | 7/2007 | Purvis et al. |
| 7,293,652 | B2 | 11/2007 | Learn et al. |
| 7,327,362 | B2 | 2/2008 | Grau |
| 7,366,643 | B2 | 4/2008 | Verdura et al. |
| 7,406,194 | B2 | 7/2008 | Aizikowitz et al. |
| 7,647,752 | B2 | 1/2010 | Magnell |
| 7,832,560 | B2 | 11/2010 | Tilton |
| 2002/0085001 | A1 | 7/2002 | Taylor |
| 2002/0118874 | A1 | 8/2002 | Chung et al. |
| 2003/0012454 | A1 | 1/2003 | Manico et al. |
| 2003/0035138 | A1 | 2/2003 | Schilling |
| 2003/0052021 | A1 | 3/2003 | Mc Kenzie |
| 2003/0083763 | A1 | 5/2003 | Kiyohara et al. |
| 2003/0091227 | A1 | 5/2003 | Chang et al. |
| 2003/0164875 | A1 | 9/2003 | Myers |
| 2003/0200111 | A1 | 10/2003 | Damji |
| 2004/0073407 | A1 | 4/2004 | Nguyen et al. |
| 2004/0120603 | A1 | 6/2004 | Gupta |
| 2005/0005261 | A1 | 1/2005 | Severin |
| 2005/0050052 | A1 | 3/2005 | Zimmerman et al. |
| 2005/0249400 | A1 | 11/2005 | Fukumoto |
| 2006/0080274 | A1 | 4/2006 | Mourad |
| 2006/0155561 | A1 | 7/2006 | Harper |
| 2006/0217831 | A1 | 9/2006 | Butterworth et al. |
| 2006/0284360 | A1 | 12/2006 | Hume et al. |
| 2007/0041035 | A1 | 2/2007 | Sembower et al. |
| 2007/0042885 | A1 | 2/2007 | Rietjens et al. |
| 2007/0112460 | A1 | 5/2007 | Kiselik |
| 2007/0172986 | A1 | 7/2007 | Huang et al. |
| 2007/0237424 | A1 | 10/2007 | Burg et al. |
| 2007/0248394 | A1 | 10/2007 | Isowa |
| 2008/0048308 | A1 | 2/2008 | Lam |
| 2008/0255945 | A1 | 10/2008 | Percival et al. |
| 2009/0063381 | A1 | 3/2009 | Chan et al. |
| 2009/0070213 | A1 | 3/2009 | Miller et al. |
| 2009/0236752 | A1 | 9/2009 | Lee et al. |
| 2009/0254322 | A1 | 10/2009 | Herman et al. |
| 2009/0282782 | A1 | 11/2009 | Walker et al. |
| 2009/0287632 | A1 | 11/2009 | Gombert et al. |
| 2009/0287717 | A1 | 11/2009 | Gombert et al. |
| 2010/0060909 | A1 | 3/2010 | Conescu et al. |
| 2010/0098319 | A1 | 4/2010 | Gombert et al. |
| 2010/0110479 | A1 | 5/2010 | Gombert et al. |
| 2010/0222908 | A1 | 9/2010 | Gombert et al. |

OTHER PUBLICATIONS http/www.esko.com/tmp/080606115325/G2558322_Kongsberg_tables_us_pdf.

Chen, "A Knowledge Base System for Carton Package Design", GA2008, 11th Generative Art Conference Dec. 2008.

* cited by examiner

LINKED LIST SEQUENCE:

F1 – F13
F5 – F2
F5 – F8
F11 – F3
F11 – F9
F12 – F4

FIG. 6

SYSTEM AND METHOD FOR AUTOMATING PACKAGE ASSEMBLY

BACKGROUND

The disclosed embodiments relate generally to methods and systems for assembling packages.

Assembly lines require a strict processing order to manufacture goods, such as packaging products. Assembly lines that produce packages are adjusted based on the structure of the package being assembled. Each package assembly process utilizes specialized equipment, possibly including robotic machinery and/or a team of workers. The equipment requires a specific set of instructions for each type of package assembled and workers are given instructions on how to manually perform the steps necessary to create a given type of package. As such, packaging assembly systems are designed to accommodate specific predetermined package structures.

However, such systems are often adapted to permit customization or alteration of the package based on customer desires. For example, while an automobile production line could be configured to produce a particular make and model of car, the assembled cars typically have different specifications, such as leather or cloth seating, a standard CD player or a multidisc CD changer, and exterior paint color. Similarly, packaging systems can produce packages with different designs colors and/or labels.

These variations in packaging can cause significant delays in assembly time. As such, it is time consuming and expensive to personalize packages or change the design of a package for a short production run.

SUMMARY

In an embodiment, a method of automatically assembling a package includes: (i) maintaining a data structure that includes a dynamic rule set for package productions (ii) selecting a desired package for assembly; (iii) automatically developing an assembly sequence to create a three dimensional package from the dynamic rule set based on the desired package; and (iv) assembling the desired package using the assembly sequence.

In an alternate embodiment, a system for automatically assembling a package includes: (i) a knowledge base configured to maintain a dynamic rule set for package production; (ii) a computing device configured to select a desired package for assembly and automatically develop an assembly sequence to create a three dimensional package from the dynamic rule set based on the desired package; and (iii) one or more assembly devices configured to assemble the desired package using the assembly sequence.

In an alternate embodiment, a method of automatically assembling a package includes (i) maintaining a data structure comprising a dynamic rule set for package production, receiving a selection of a desired package for assembly; (ii) accessing the rule set to automatically develop a sequence of cuts, creases and folds to create a three dimensional package containing multiple facets from the dynamic rule set based on the desired package, wherein the sequence is dynamically created and not pre-defined; and (iii) assembling the three-dimensional package using the sequence of cuts, creases and folds.

BRIEF DESCRIPTION OF THE DRAWINGS

Aspects, features, benefits and advantages of the embodiments described herein will be apparent with regard to the following description, appended claims, and accompanying drawings where:

FIG. 6 depicts the dependency sequence created from processing the tree representation of FIG. 4 according to an embodiment.

DETAILED DESCRIPTION

Figure 1:
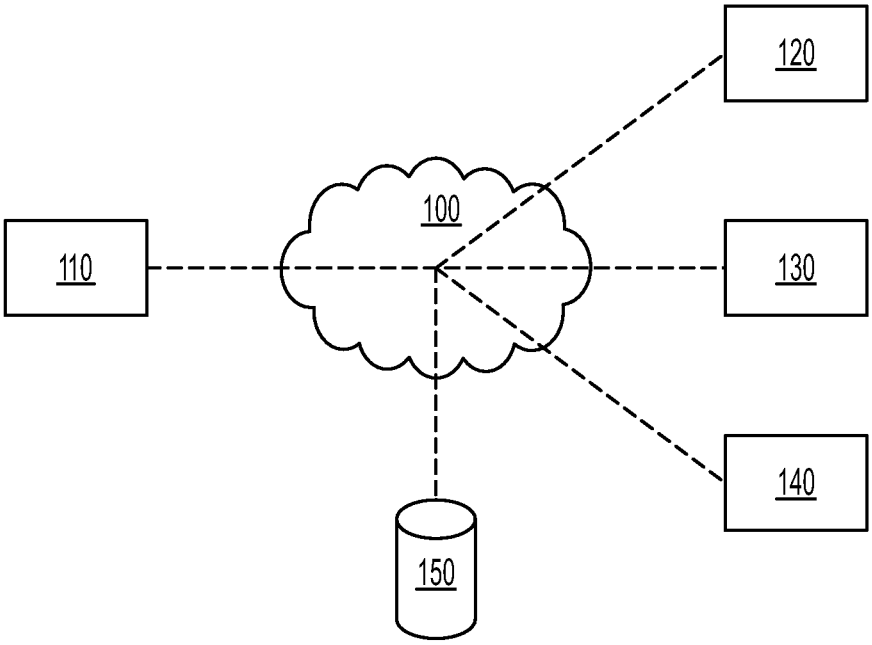
FIG. 1 illustrates a system for assembling a package according to an embodiment.

Before the present methods are described, it is to be understood that this invention is not limited to the particular systems, methodologies or protocols described as these may vary. It is also to be understood that the terminology used herein is for the purpose of describing particular embodiments only, and is not intended to limit the scope of the present disclosure which will be limited only by the appended claims.

As used herein and in the appended claims, the singular forms "a," "an," and "the" include the plural reference unless the context clearly dictates otherwise. Thus, for example, reference to a "document" is a reference to one or more documents and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

An "assembly device" is a device or machine used in an assembly line that performs an operation. For example, an assembly device may be used in a package construction process. An assembly device may perform operations such as, but not limited to, printing, scanning, faxing, folding, sealing, creasing and/or perforating.

A "computing device" processes data to perform one or more functions. A computing device may be any processor-based device such as, for example, a server, a personal computer, a personal digital assistant, a web-enabled phone, a smart terminal, a dumb terminal and/or other electronic device capable of communicating in a networked environment.

A "facet" is a part of the structure of a package. For example, a facet may be a flap or side of the desired package.

A "facet identifier" is used to identity a particular facet on the package. Facet identifiers may include, but are not limited to, alphanumeric characters.

A "knowledge base" is an electronic repository of searchable data. A knowledge base may refer to a software component, such as, but not limited to, a database or a table. Alternatively, a knowledge base may refer to a hardware component, such as, but not limited to, a tangible storage medium.

A "node" is a branch of a tree in a tree representation. Each node represents a facet of the package.

An "adjacent arc" is a connection element depicted in a tree representation that connects two nodes when the facets corresponding to the node are adjacent to each other. For example, if node B has an adjacent arc to node C, then facet B is adjacent to facet C.

An "origination node" is a node where an arc begins.

A "destination node" is a node where an arc ends. As depicted in the figures herein, an arrow of an arc points at a destination node.

A "dependency arc" is a connection element depicted in a tree representation that connects an origination node to a destination node. A dependency are indicates that an origination node must be processed before a destination node, or dependent node, is processed. For example, if a dependency arc connects node B to node A, node B must be processed prior to node A.

A "dependency relationship pair" is an origination node and a destination node of a particular dependency arc. In an embodiment, a dependency relationship pair may refer to node values that are added to a dependency sequence.

FIG. 1 illustrates a system for assembling a package according to an embodiment. As shown in FIG. 1, the system may include a computing device 110, one or more assembly devices 120, 130 140, a knowledge base 150 and a network 100.

A computing device 110 may function as an assembly orchestrator. As such, the computing device 110 may provide assembly coordination of one or more assembly devices 120, 130, 140, including, but not limited to, assembly planning and assembly management. Assembly planning may include, but is not limited to, determining an assembly sequence. Assembly management may include, but is not limited to, ensuring assembly integrity, quality control, error recovery, status and/or reporting.

An assembly device 120, 130, 140 may access a knowledge base 150. Alternatively, the knowledge base 150 may be contained within one or more of the assembly devices 120, 130, 140. In an embodiment, the knowledge base 150 may include assembly capabilities for each assembly device. Assembly capabilities may include, but are not limited to, the ability to fold, crease, seal, perforate and/or print. Assembly capabilities may also include the amount of time it takes for an assembly device to fold, crease, seal, perforate and/or print.

The knowledge base 150, the computing device 110 and the one or more assembly devices 120, 130, 140 may communicate via a network 100, such as a local area network (LAN), a wide area network (WAN), the Internet, a universal serial bus (USB) network, a Bluetooth network and/or any other communications network. In an embodiment, the knowledge base 150 may be distributed across a plurality of devices including, but not limited to, the computing device 110 and/or the one or more assembly devices 120, 130, 140. If the knowledge base 150, or a portion thereof, is contained within the one or more assembly devices 120, 130, 140 or the computing device 110, the knowledge base may directly communicate with the computing device or the assembly devices instead of via the network 100.

Figure 2:
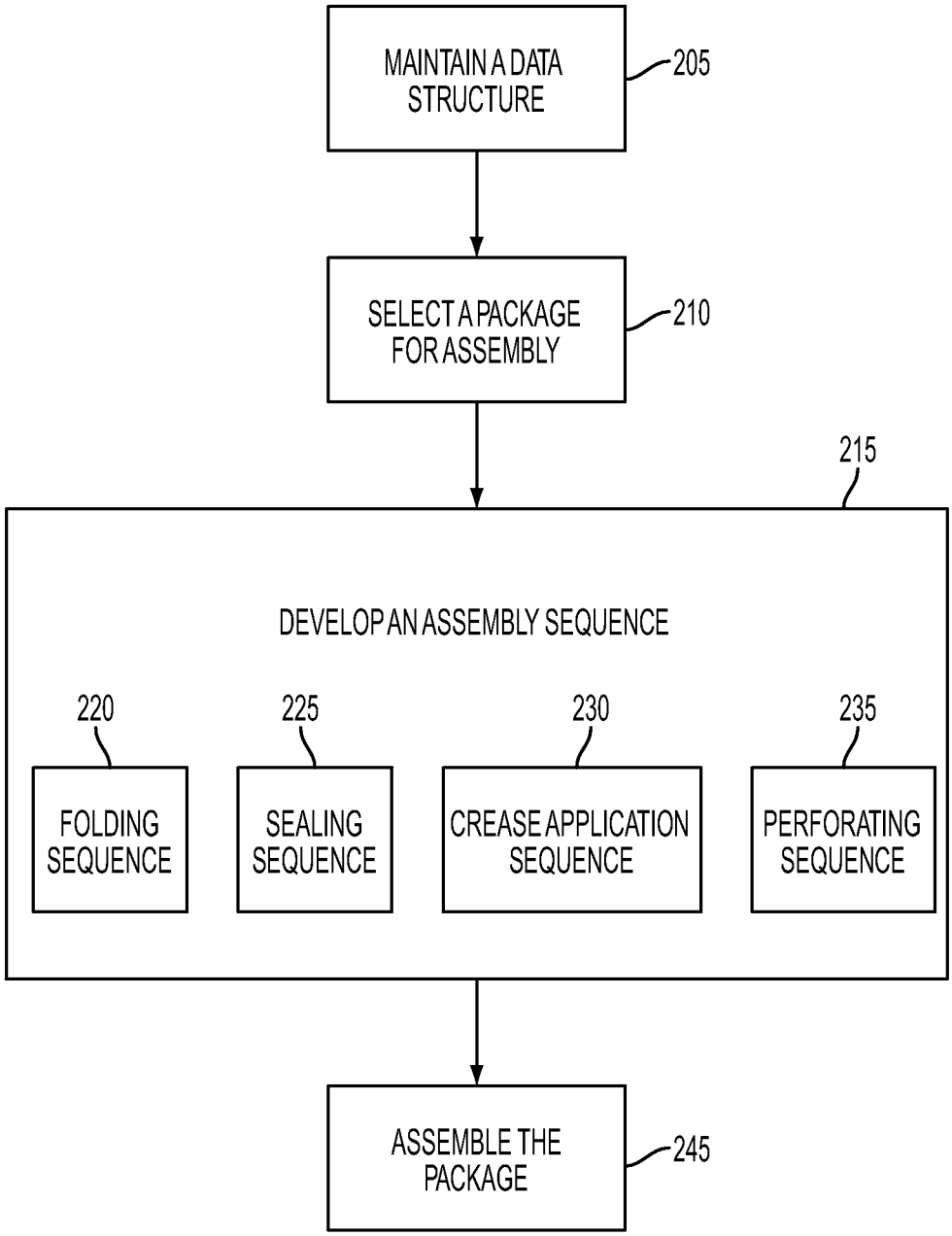
FIG. 2 depicts a flowchart of an exemplary method of automatically assembling a package according to an embodiment.

FIG. 2 depicts a flowchart of an exemplary method of automatically assembling a package according to an embodiment. A data structure may be maintained 205. The data structure may include a dynamic rule set for package production. For example, a dynamic rule set may include a set of constraints used in the construction of a package. Any appropriate data structure can be used, such as an XML-based structure that defines creases, cuts, edge boundaries for various facets, relationships between facets, constraints, and other features of various package elements. The rule set also may include constraints or rules based on the capabilities of the package assembly devices. The rule set is dynamic in that it can be used not only to create pre-defined packages, but also new or non-pre-defined packages designed by a user of the system or created based on user intents. Optionally, as new packages are developed by users or based on user intents, the dynamic rule set may be updated to remember the combination of rules used to create the new package structure.

A desired package may be selected 210 for assembly. In an embodiment, the package may be automatically selected 210. In an embodiment, a package may he selected 210 by a user. In an embodiment, a user may select 210 a package from a predetermined set of packages. In an embodiment, a user may create or design 210 a package.

Based on the desired package and the assembly capabilities for one or more assembly devices, an assembly sequence may be automatically developed 215. Automatically developing an assembly sequence 215 may include applying the dynamic rule set to a knowledge base of assembly capabilities for one or more assembly devices. Various operations may be performed to assemble the package. For example, the packaging material may be folded, sealed, creased and/or perforated during assembly.

Figure 3:
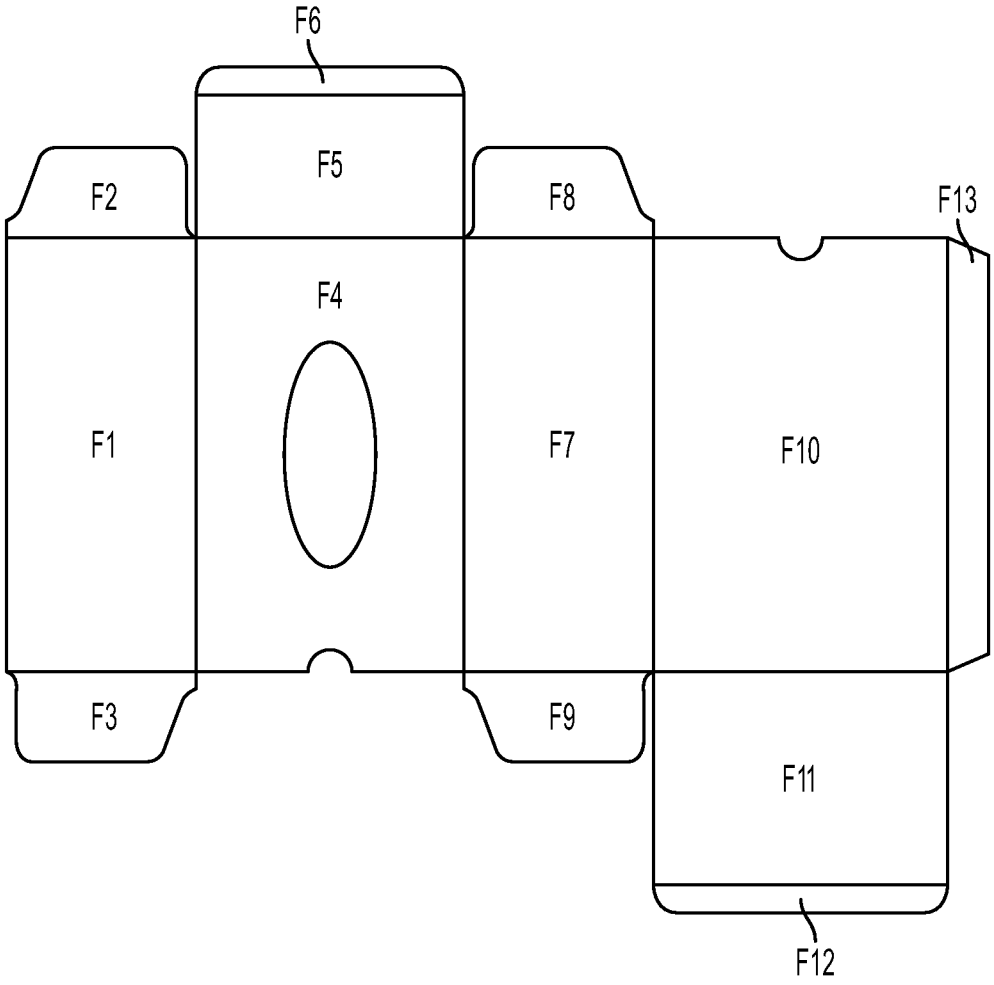
FIG. 3 depicts a layout of the desired package for determining the assembly sequence according to an embodiment.

FIG. 3 depicts a layout of the desired package for determining the assembly sequence according to an embodiment. Each flap, panel, edge and/or tab of the package may be a facet. Flap types may include, but are not limited to, a glue flap, a dust flap, a tuck flap, a male lock flap, a female lock flap and/or a bellow. Panel types may include, but are not limited to, an end panel, a top panel, a side panel, a charlotte, a flange, a cover panel, a front panel and/or a back panel. Edge types may include, but are not limited to, a cut, a crease, a perforation and/or an imaginary edge.

A facet identifier may be used to identify each facet of the desired package. In FIG. 3, facet identifiers, such as F1-F13, each depict a facet of the package. An assembly sequence may be created by ordering the facet identifiers in a sequence that can be used to produce the desired package. Interrelated facets may provide constraints for assembly used in developing the assembly sequence.

Referring back to FIG. 2, in an embodiment, developing an assembly sequence may include operations such as folding 220, sealing 225, creasing 230, perforating 235, and/or other operations necessary for assembling a package. In an embodiment, each operation may be incorporated into the assembly sequence. In an alternate embodiment, each operation may have a separate assembly sequence.

In an embodiment, automatically developing 215 an assembly sequence may include automatically developing 220 a folding sequence. Assembling the desired package may include automatically applying, using the folding sequence, a plurality of folds. Folding may include simply creating an angle and or overlapping one or more facets, optionally in a manner such that the facets are mated (i.e., joined or attached) such as by a tab/slot, overlap, or other joining feature.

In an embodiment, automatically developing 215 an assembly sequence may include automatically developing 225 a sealing sequence. Assembling the desired package may include automatically applying, using the sealing sequence, a plurality of seals. Sealing may include, but is not limited to, gluing, taping, stapling, sticking, pasting, bonding and/or other adhesive materials.

In an embodiment, automatically developing 215 an assembly sequence may include automatically developing 230 a crease application sequence. Assembling the desired package may include automatically applying, using the crease application sequence, a plurality of creases.

In an embodiment, automatically developing 215 an assembly sequence may include automatically developing 235 a perforating sequence. Assembling the desired package may include automatically applying using the perforating sequence, a plurality of perforations.

Dependency folds are constraints that define an order for the assembly sequence. A dependency fold is a type of dependency arc. Based on the operation being performed, the dependency arcs may be referred to as dependency perforations, dependency folds and/or dependency seals. Accordingly, the term "dependency folds" may be used in place of dependency arcs.

Dependency folds may be used to define the order in which folds are performed during a package assembly. For example, if facet A is dependent on facet B, then facet A may overlap facet B when the package is assembled. In an embodiment, the dependency folds may be calculated based on the interrelated facets that provide structural attachment. In an alternate embodiment, the dependency folds may be determined by a structural designer. In an embodiment, the dependency folds may determine constraints used in the assembly algorithm for deriving the appropriate sequence for folding operations performed by an assembly line.

Figure 4:
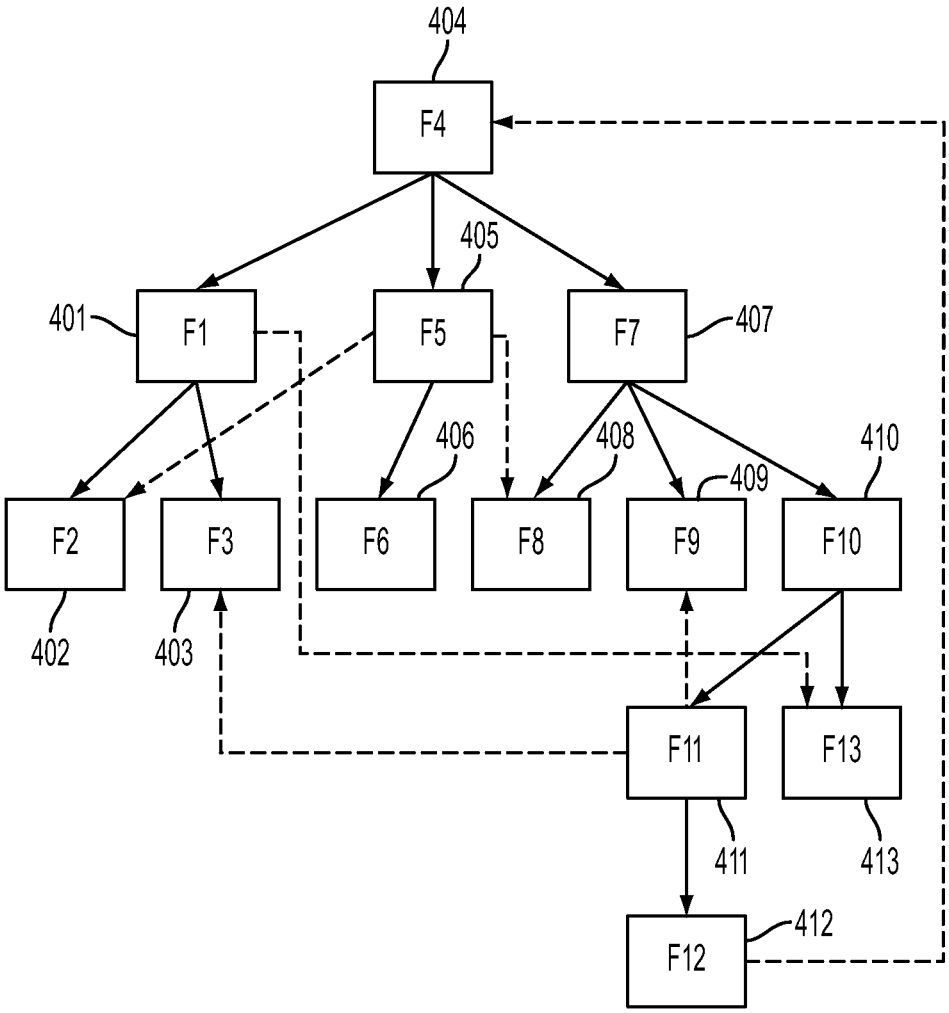
FIG. 4 depicts an exemplary tree representation of a three-dimensional package according to an embodiment.

FIG. 4 depicts an exemplary tree representation for a three-dimensional package according to an embodiment. In FIG, 4, a tree representation is depicted for a folding sequence of the package assembly. The root of the assembly tree may be determined by identifying the structural base. In an embodiment, the structural base may be the bottom panel or facet of the desired package. In an alternate embodiment, the structural base may be the front panel or facet of the desired package. Alternate structural bases may also be used within the scope of this disclosure.

After the root of the assembly tree is determined, the various facets of the package may be added to the tree. Each facet of the package may be depicted by a node. The nodes of the tree may be connected by adjacent arcs, which are depicted in FIG. 5 as solid lines. The nodes of the tree may also be connected by dependency arcs, which are depicted in FIG. 4 as dashed lines. A dependency arc, as discussed above, may be based on facet group relationships and assembly line capabilities. For example, node F4 404 may be dependent on node F12 412 and adjacent to nodes F1 401, F3 403, and F7 407.

Based on the layout of the tree representation, such as the one shown in FIG. 4, the sequence of an operation, such as folding, may he automatically determined by processing the tree. Beginning at the top of the tree, at each step, the first node that has no dependent arcs pointing to it may be added to the tail of a dependency sequence and any dependency arcs originating from that node may be removed from the tree representation. In an embodiment, the nodes may be processed from top to bottom, based on the tree representation. Each dependency arc, related to the first node, may be written to the dependency sequence until no dependency arcs originate from the first node. After the first node is processed, the next highest node in the tree which has no dependent arcs pointing to it, may be processed. This process may iterate until all nodes are processed.

Figure 5A:
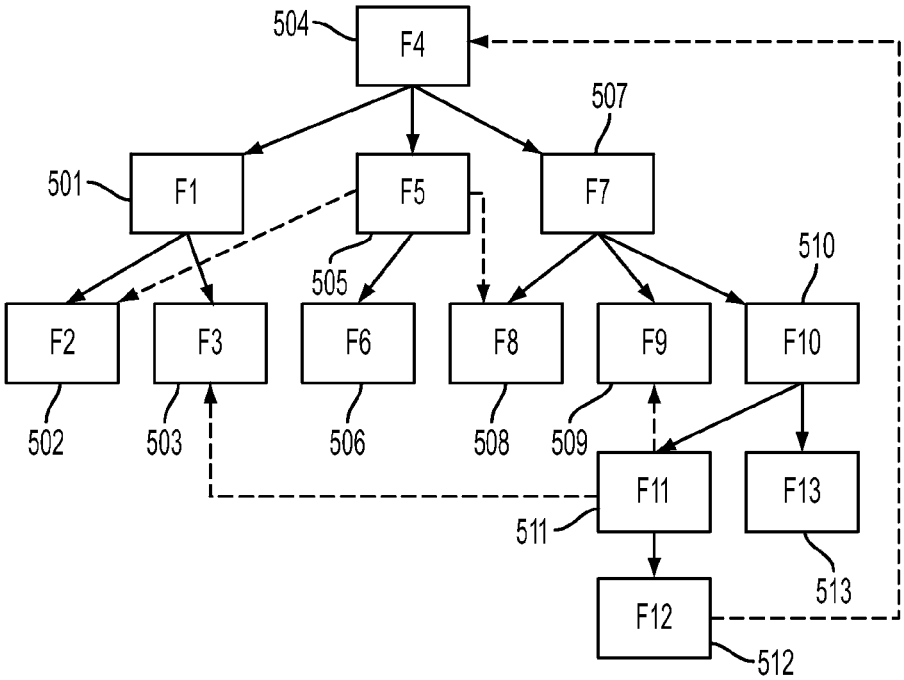
FIGS. 5A-B depict tree representations during the processing of the dependency arcs according to an embodiment.
Figure 5B:
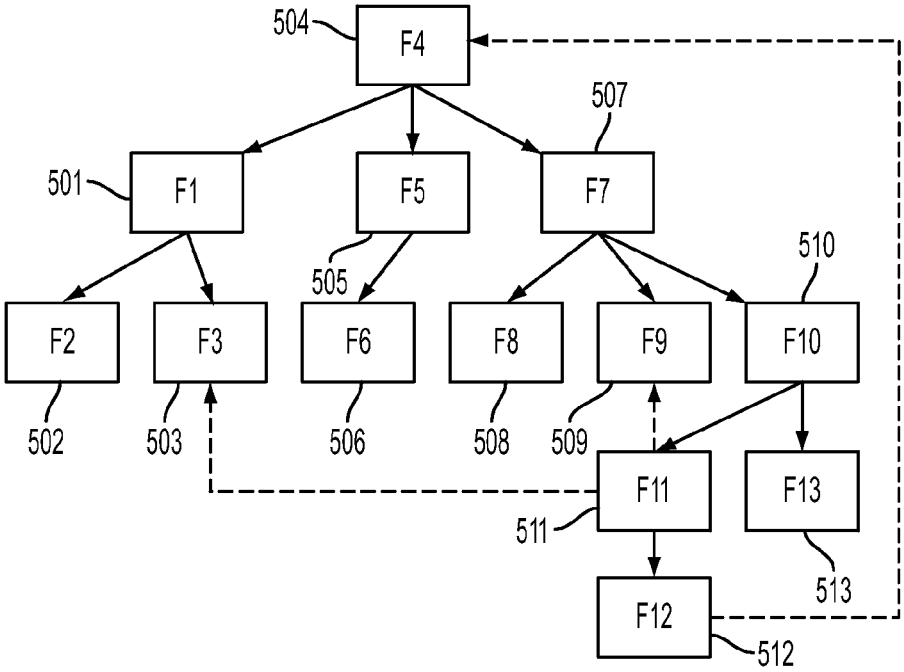

FIGS. 5A-B depict tree representations during the processing of the dependency arcs according to an embodiment. The processing may begin with node F4 504. Because a dependency arc points to node F4 504, node F4 504 cannot be processed until the originating node of the dependency arc is processed. The next highest node in the tree representation that may be processed is node F1 501. Node F1 501 has a dependency arc to node F13 513. This dependency arc may be processed by adding the dependency relationship pair to the dependency sequence and removing the dependency arc between node F1 501 and node F13 513 from the tree representation. FIG. 5A depicts the tree representation after the dependency arc from node F1 501 to node F13 513 has been removed and the dependency relationship pair has been added to the dependency sequence.

The process may continue with the next highest node in the tree, node F5 505. Two dependency arcs originate from Node F5 505 The dependent node F2 502 may be processed by adding the dependency relationship pair to the dependency sequence and removing the dependency arc from the tree representation. Also the dependent node F8 508 may be processed by adding the dependency relationship pair to the dependency sequence and removing the dependency arc from the tree representation. FIG. 5B depicts the tree representation after the dependency arcs from node F5 505 to nodes F2 502 and F8 508 have been processed.

After node F5 505 is processed the processing may continue to node F7 507. As node F7 507 has no dependency arcs, the processing may continue to node F2 502. As node F2 502 has no dependency arcs, the process may continue to node F3 503. The processing of each node may continue until all dependency arcs on the tree representation are removed from the tree representation and the dependency relationship pairs are added to the dependency sequence.

When all dependency arcs have been removed from the tree representation, the dependency sequence may be completely described and may be processed. FIG. 6 depicts the dependency sequence created from processing the tree representation of FIG. 4 according to an embodiment.

Figure 7:
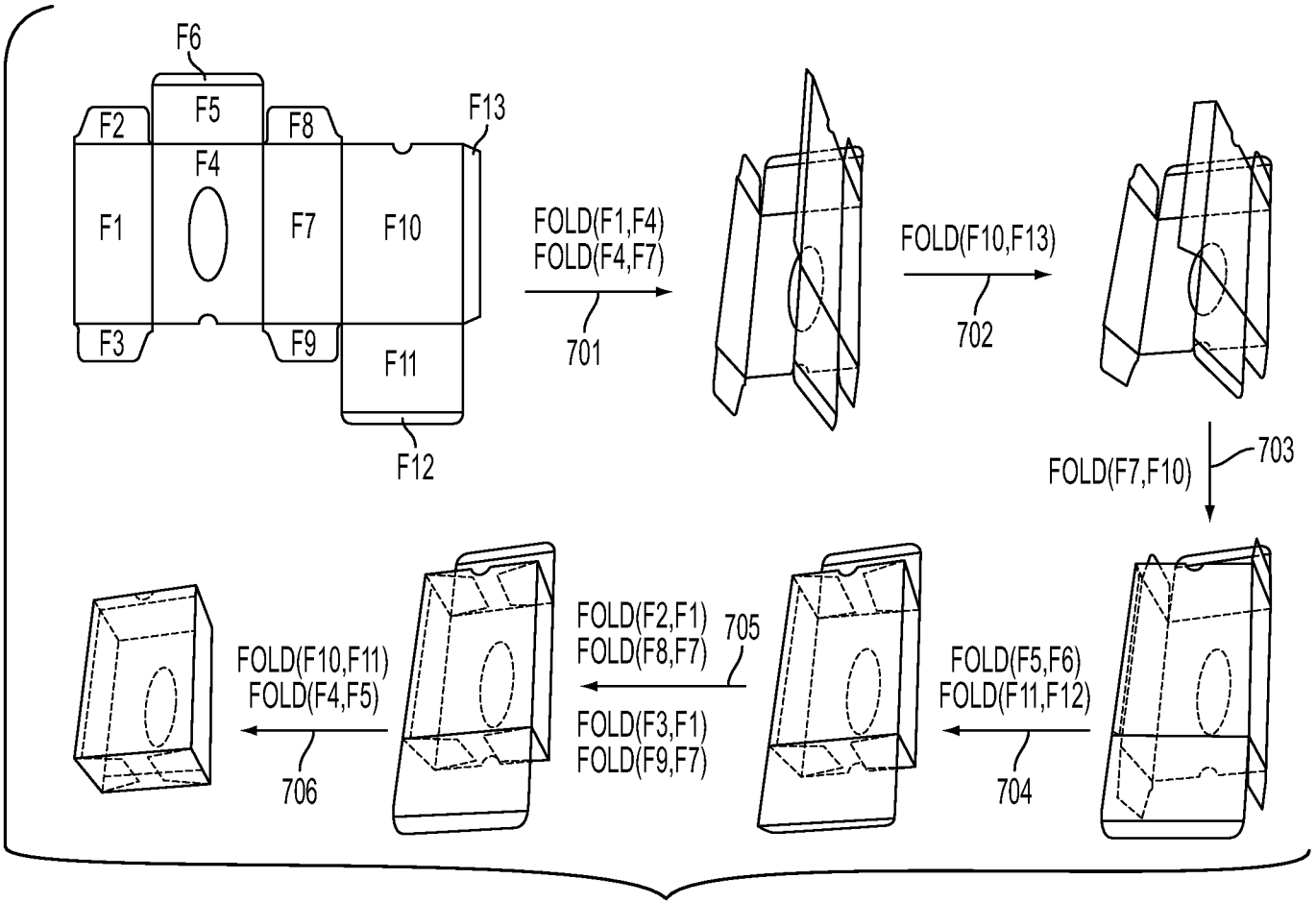
FIG. 7 depicts an exemplary assembly of a three-dimensional package from the tree representation of FIG. 4 according to an embodiment.

Returning to FIG. 2, the desired package may be assembled 245 using the dependency sequence. FIG. 7 depicts an exemplary assembly of a three-dimensional package according to an embodiment. In FIG. 7, the assembly of the three-dimensional package may be based in part on the dependency sequence of FIG. 6. The order of processing for the adjacent nodes may vary as long as the dependency nodes are processed in the order of the dependency sequence.

As shown in FIG. 7, the first folds may be facet F1 folded 701 with facet F4, and facet F4 folded with facet F7. Facet F10 maybe folded 702 with facet F13 Facet F7 may be folded 703 with facet F10. Facet F5 may be folded with facet F6, and facet F11 may be folded with facet F12. As facet F5 has already been folded (because the dependency arcs of facet or node F5, depicted in FIG. 5, were removed and processed to create the dependency sequence of FIG. 6), facet F2 may be folded 704 with facet F1, and facet F8 may be folded with facet F5. As facet F11 has already been folded (because the dependency arcs of facet F1 depicted in FIG. 5, were removed and processed to create the dependency sequence of FIG. 6), facet F3 may be folded 704 with facet F1 and facet F9 may be folded with facet F7. Finally, as facet F12 has already been folded, facet F4 may be folded with F5, and facet F10 maybe folded 706 with facet F11. After the dependency sequence is completely processed, the desired package may be complete.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of automatically assembling a package, comprising:

maintaining a data structure comprising a dynamic rule set for package production, wherein the dynamic rule set comprises a set of constraints defining assembly parameters used in assembling a plurality of packages, the set of constraints comprising a definition for each of creases, cuts, edge boundaries for various facets, relationships between facets, and constraints used to assemble each package;

receiving a user selection to create a desired package for assembly;

automatically developing an assembly sequence to create a three-dimensional package from the dynamic rule set based on the user-selected desired package, wherein developing the assembly sequence comprises:

developing a folding sequence comprising a plurality of folds determined based upon the user-selected desired package, developing a sealing sequence comprising a plurality of seals determined based upon the user-selected desired package, developing a crease application sequence comprising a plurality of creases determined based upon the user-selected desired package, and developing a perforating sequence comprising a plurality of perforations determined based upon the user-selected desired package; and assembling the desired package using the assembly sequence, wherein assembling the desired package comprises:

applying the plurality of folds based upon the folding sequence, applying the plurality of creases based upon the crease application sequence, and applying the plurality of perforations based upon the perforating sequence.

2. The method of claim 1, wherein:

automatically developing an assembly sequence comprises automatically developing the folding sequence; and assembling the desired package comprises folding, using the folding sequence, to yield a three-dimensional package.

3. The method of claim 2, wherein automatically developing the folding sequence comprises:

developing a tree representation of the three-dimensional package, wherein facets of the package are represented by a plurality of nodes, one or more adjacent folds represented by a first connection type, and one or more dependency folds represented by a second connection type, wherein each adjacent fold and each dependency fold connects a respective origination node and a destination node;

initializing the folding sequence:

identifying a node that is not a destination node for any dependency folds;

adding a dependency relationship pair to the folding sequence for each dependency fold for which the node is an origination node;

removing the dependency fold corresponding to the dependency relationship pair added to the folding sequence; and repeating the identifying, adding and removing until all dependency folds for all nodes in the tree representation are removed.

4. The method of claim 2, wherein the folding sequence comprises mating a first facet and a second facet.

5. The method of claim 1, wherein:

automatically developing an assembly sequence comprises automatically developing a sealing sequence; and assembling the desired package comprises sealing, using the sealing sequence, to yield a three-dimensional package.

6. The method of claim 5, wherein automatically developing a sealing sequence comprises:

developing a tree representation of the three-dimensional package, wherein facets of the object are represented by a plurality of nodes, one or more adjacent seals represented by a first connection type, and one or more dependency seals represented by a second connection type, wherein each adjacent seal and each destination seal connects a respective origination node and a destination node;

initializing a sealing sequence;

identifying a node that is not a destination node for any dependency seals;

adding a dependency relationship pair to the sealing sequence for each dependency seal for which the node is an origination node;

removing the dependency seal corresponding to the dependency relationship pair added to the sealing sequence; and repeating the identifying, adding and removing until all dependency seals for all nodes in the tree representation are removed.

7. The method of claim 1, wherein:

automatically developing an assembly sequence comprises automatically developing a crease application sequence; and assembling the desired package comprises automatically applying, using the crease application sequence, a plurality of creases.

8. The method of claim 7, wherein automatically developing a crease application sequence comprises:

developing a tree representation of the three-dimensional packages wherein facets of the package are represented by a plurality of nodes, one or more adjacent creases represented by a first connection type and one or more dependency creases represented by a second connection type, wherein each adjacent crease and each destination crease connects a respective origination node and a destination node:

initializing a crease application sequence;

identifying a node that is not a destination node for any dependency creases;

adding a dependency relationship pair to the crease application sequence for each dependency crease for which the node is an origination node;

removing the dependency crease corresponding to the dependency relationship pair added to the crease application sequence; and repeating the identifying, adding and removing until all dependency creases for all nodes in the tree representation are removed.

9. The method of claim 1, wherein:

automatically developing an assembly sequence comprises automatically developing a perforation sequence; and assembling the desired package comprises automatically applying, using the perforation sequence, a plurality of perforations.

10. The method of claim 9, wherein the automatically developing a perforation sequence comprises:

developing a tree representation of the three-dimensional package, wherein facets of the object are represented by a plurality of nodes, one or more adjacent perforations represented by a first connection type, and one or more dependency perforations represented by a second connection type, wherein each adjacent perforation and each destination perforation connects a respective origination node and a destination node;

initializing a perforation sequence;

identifying a node that is not a destination node for any dependency perforations;

adding a dependency relationship pair to the perforation sequence for each dependency perforation for which the node is an origination node;

removing the dependency perforation corresponding to the dependency relationship pair added to the perforation sequence; and repeating the identifying, adding and removing until all dependency perforations for all nodes in the tree representation are removed.

11. The method of claim 1, wherein automatically developing the assembly sequence comprises applying the rule set to a knowledge base of assembly capabilities of one or more assembly devices.

12. A system for automatically assembling a package, comprising:

a knowledge base to maintain a dynamic rule set for package production, wherein the dynamic rule set comprises a set of constraints defining assembly parameters used in assembling a plurality of packages, the set of constraints comprising a definition for each of creases, cuts, edge boundaries for various facets, relationships between facets, and constraints used to assemble each package;

a computing device to:

receiving a user selection to create a desired package for assembly, and automatically develop an assembly sequence to create a three-dimensional package from the dynamic rule set based on the user-selected desired package, wherein developing the assembly sequence comprises:

developing a folding sequence comprising a plurality of folds determined based upon the user-selected desired package, developing a sealing sequence comprising a plurality of seals determined based upon the user-selected desired, developing a crease application sequence comprising a plurality of creases determined based upon the user-selected desired package, and developing a perforating sequence comprising a plurality of perforations determined based upon the user-selected desired package; and one or more assembly devices to assemble the desired package using the assembly sequence, wherein assembling the desired package comprises:

applying the plurality of folds based upon the folding sequence, applying the plurality of creases based upon the crease application sequence, and applying the plurality of perforations based upon the perforating sequence.

13. The system of claim 12, wherein automatically developing an assembly sequence comprises automatically developing the folding sequence.

14. The system of claim 13, wherein automatically develop the folding sequence comprises:

developing a tree representation of the three-dimensional package, wherein facets of the package are represented by a plurality of nodes, one or more adjacent folds are represented by a first connection type, and one or more dependency folds are represented by a second connection type, wherein each adjacent fold and each dependency fold connects a respective origination node and a destination node;

initializing the folding sequence;

identifying a node that is not a destination node for any dependency folds;

adding a dependency relationship pair to the folding sequence for each dependency fold for which the node is an origination node;

removing the dependency fold corresponding to the dependency relationship pair added to the folding sequence; and repeating the identifying, adding and removing until all dependency folds for all nodes in the tree representation are removed.

15. The system of claim 12, wherein automatically developing an assembly sequence comprises automatically developing a sealing sequence.

16. The system of claim 12, wherein automatically developing an assembly sequence comprises automatically developing a crease application sequence.

17. The system of claim 12, wherein automatically developing an assembly sequence comprises automatically developing a perforation sequence.

18. The system of claim 12, further comprising:

a second knowledge base of assembly capabilities of one or more assembly devices.

19. The system of claim 18, wherein automatically developing the assembly sequence comprises developing the assembly sequence by applying the rule set to the assembly capabilities of the one or more assembly devices.

* * * * *